US007806255B1

(12) United States Patent
Staver

(10) Patent No.: US 7,806,255 B1
(45) Date of Patent: Oct. 5, 2010

(54) JEWELRY DISPLAY

(76) Inventor: Henrietta B. Staver, 2803 Raeford Rd., Fayetteville, NC (US) 28303

( * ) Notice: Subject to any disclaimer, the term of this patent is extended or adjusted under 35 U.S.C. 154(b) by 793 days.

(21) Appl. No.: 11/731,922

(22) Filed: Apr. 2, 2007

(51) Int. Cl.
*A45C 11/04* (2006.01)

(52) U.S. Cl. ..... 206/6.1; 312/227

(58) Field of Classification Search ..... 206/6.1, 206/566; 312/210, 227, 226, 224
See application file for complete search history.

(56) References Cited

U.S. PATENT DOCUMENTS 2,104,214 A * 1/1938 Vezina ..... 312/234
2,445,164 A * 7/1948 Worthman ..... 160/127
4,811,996 A * 3/1989 Hansson ..... 312/132
5,107,871 A * 4/1992 Butcher et al. ..... 132/304
5,431,177 A * 7/1995 Kecman ..... 132/303
2002/0196333 A1* 12/2002 Gorischek ..... 348/61
2008/0185299 A1* 8/2008 Thorman ..... 206/6.1

* cited by examiner

*Primary Examiner*—Jacob K Ackun, Jr.

(57) ABSTRACT

A jewelry display for ease and convenience having a front frame hingedly connected to a rear compartment. The front frame includes a mirror and screen which can be opened for retrieval or storage of jewelry or other small objects on a series of shelves, slots and posts mounted in the rear compartment. A pair of magnets maintains the front frame in a closed posture with the rear compartment. Hooks are also available for jewelry suspension on the front of the frame beneath the screened mirror. When the jewelry display is closed, the mirror in the front frame allows the user to observe the jewelry worn and the screen permits a convenient attachment of jewelry during dressing.

3 Claims, 4 Drawing Sheets

JEWELRY DISPLAY

FIELD OF THE INVENTION

The invention herein pertains to a wall mounted display and particularly pertains to a jewelry storage display for use while dressing.

DESCRIPTION OF THE PRIOR ART AND OBJECTIVES OF THE INVENTION

Cosmetic and jewelry applications require time and care to obtain the desired image for the user. Small items such as rings, bracelets, earrings, necklaces, pins, various hair ornaments and the like can easily be misplaced if not properly stored and organized. As jewelry is conventionally kept in small drawers, jewelry boxes, chests and the like often particular pieces are concealed by other jewelry stored therewith. Earrings having detachable fasteners are frequently separated resulting in concern and frustration at time of use.

Storage areas for jewelry are often not close to bathrooms or dressing areas in many homes and apartments, again causing inconvenience for the jewelry wearer when trying to quickly achieve a desired image.

Thus with the problems and disadvantages of conventional jewelry storage and application, the present invention was conceived and one of its objectives is to provide a convenient jewelry display which can be mounted on a vertical wall or the like for easy access.

It is another objective of the present invention to provide a jewelry display which has sufficient storage capacity for a sizable jewelry collection.

It is still another objective of the present invention to provide a jewelry display which can be readily closed for security purposes when not in use.

It is yet another objective of the present invention to provide a jewelry display which has a screened mirror front for assistance during dressing and jewelry application.

Various other objectives and advantages of the present invention will become apparent to those skilled in the art as a more detailed description is set forth below.

SUMMARY OF THE INVENTION

The aforesaid and other objectives are realized by providing a rectangularly shaped jewelry display having a front frame hingedly attached to a rear storage compartment. A pair of magnets are provided to maintain closure of the jewelry display with one magnet positioned in the front frame and the other magnet opposingly positioned on the rear storage compartment. The rear storage compartment is of a sufficient depth and includes a plurality of shelves for sufficient storage of a relatively large amount of jewelry. Rings, bracelets, earrings, necklaces and the like can be positioned on the shelves in shelf slots or affixed to a series of posts. Wall fasteners attached to the outside of the rear compartment allow the jewelry display to be suspended from a vertical wall, door or other convenient structure. A felt fabric covers the outside of the rear storage compartment to provide a protective layer between the display and the wall. The front frame includes a mirror having a screen positioned thereon for easy visibility and use while dressing to achieve the desired aesthetic image. The screen provides a convenient, temporary storage or placement for earrings or the like during selection. A series of hooks affixed to the front of the frame, beneath the mirror allow for suspension of heavier objects such as necklaces or bracelets. A user is thus able to quickly access, adorn and view the contained jewelry.

DETAILED DESCRIPTION OF THE PREFERRED EMBODIMENT AND OPERATION OF THE INVENTION

Figure 1:
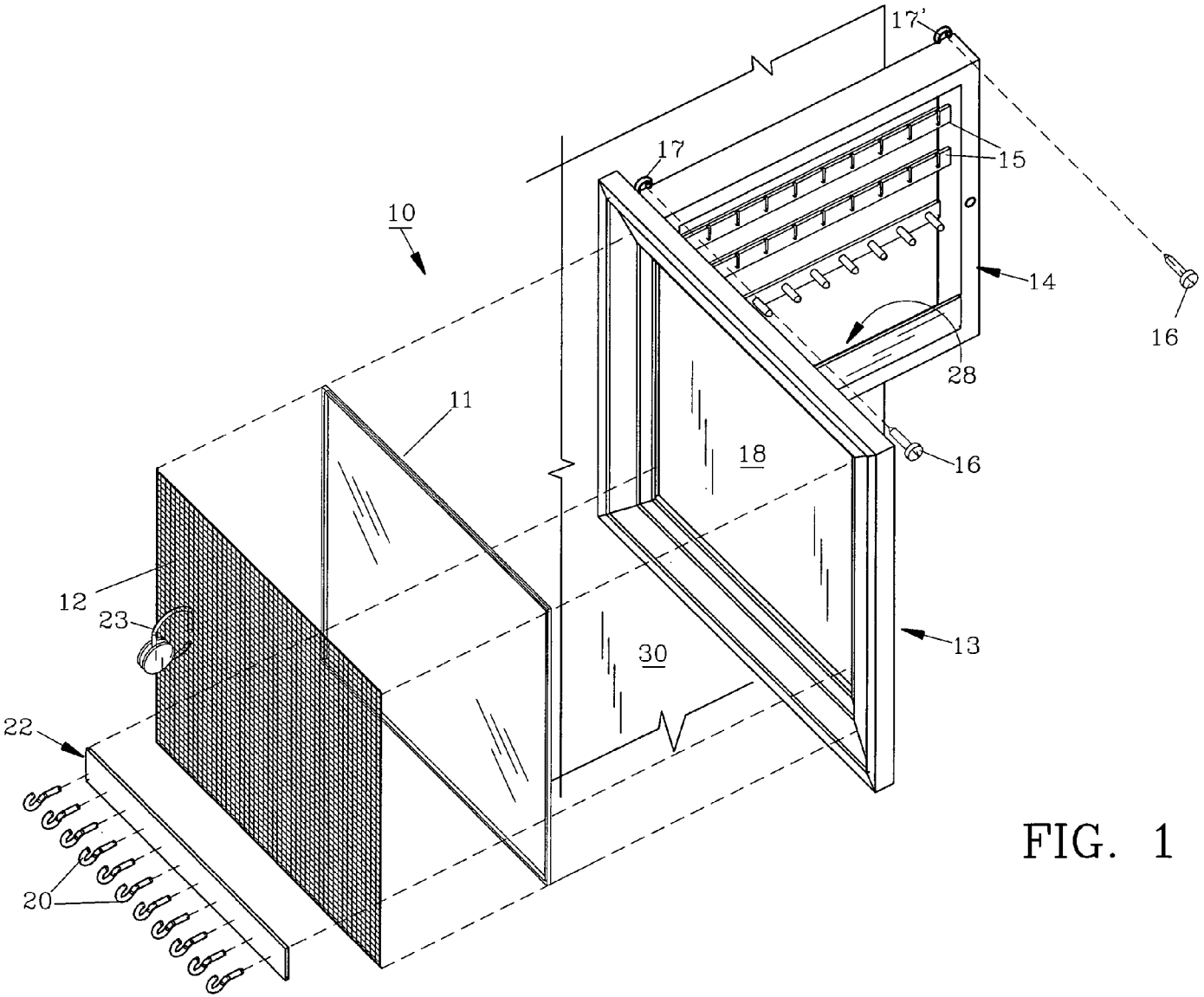
FIG. 1 illustrates the preferred form of the jewelry display in a partially open, schematic view with the mirror, screen and hooks exploded therefrom as positioned on a wall.
Figure 3:
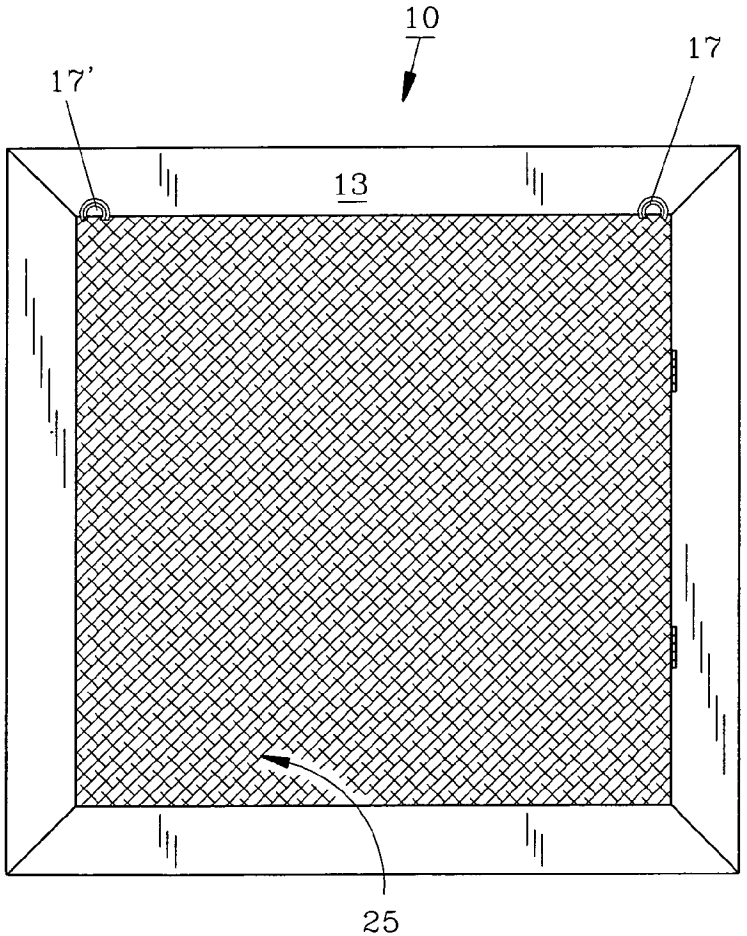
FIG. 3 depicts a rear elevational view of the jewelry display as seen in FIG. 2.
Figure 6:
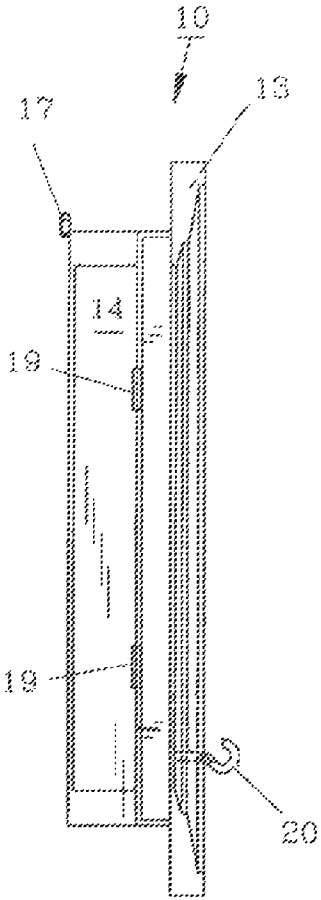
FIG. 6 shows a left side elevational view of the jewelry display as seen in FIG. 2.
Figure 8:
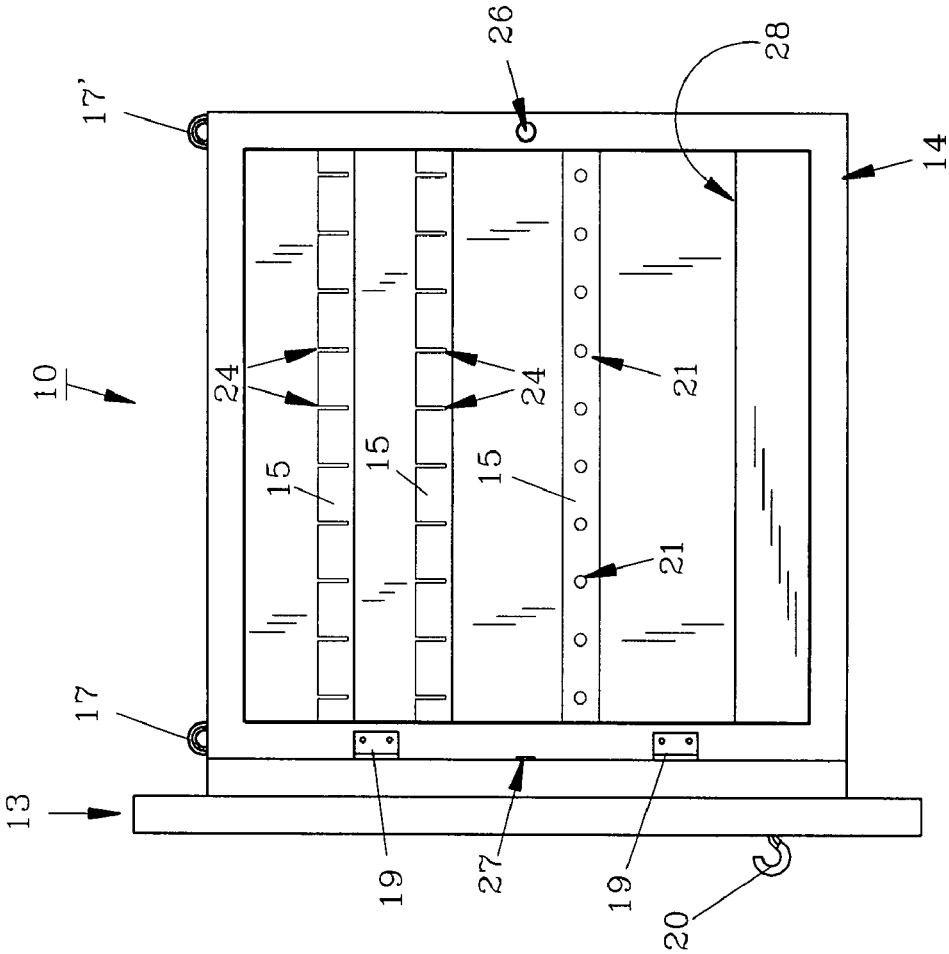
FIG. 8 demonstrates a front elevational view of the jewelry display as seen in FIG. 1.

For a better understanding of the invention and its operation, turning now to the drawings, FIG. 1 demonstrates preferred jewelry display 10 shown in a partially open view with mirror 11, screen 12, hook support 22 and hooks 20 exploded from front frame 13. As illustrated, mirror 11 and screen 12 fit within frame 13 allowing approximately an eighth of an inch (⅛" or 0.317 cm) space between mirror 11 and screen 12. Mirror support 18 in front frame 13 provides support and a protective backing for mirror 11. Hook support 22 having a plurality of hooks 20 affixed thereon is positioned atop screen 12. Front frame 13 is hingedly joined to rear compartment 14 with a pair of conventional hinges 19 as seen in FIGS. 6 and 8. Rear compartment 14 includes a number of shelves 15 preferably two (2) as shown in FIG. 8 for maintaining rings, earrings, bracelets or other objects thereon. Preferred jewelry display 10 is approximately sixteen inches (16" or 40.6 cm) wide, sixteen inches (16" or 40.6 cm) high and about two and three quarter inches (2.75" or 7 cm) deep when closed. A pair of magnets 26, are seen to maintain front frame 13 closed with rear compartment 14. In FIG. 8, magnet 26 is positioned on rear compartment 14 while magnet 27 is affixed to front frame 13. Wall fasteners 17, 17' (FIG. 3) are attached to the outside of rear compartment 14 for suspending jewelry display 10 from a wall, door or other convenient vertical structure. As seen in FIG. 3, standard felt fabric 25 is provided along the back of rear compartment 14 to provide protection between display 10 and the vertical structure such as wall 30 seen in FIG. 1. Felt fabric 25 prevents scratching or marring such as may occur to wall 30.

Figure 2:
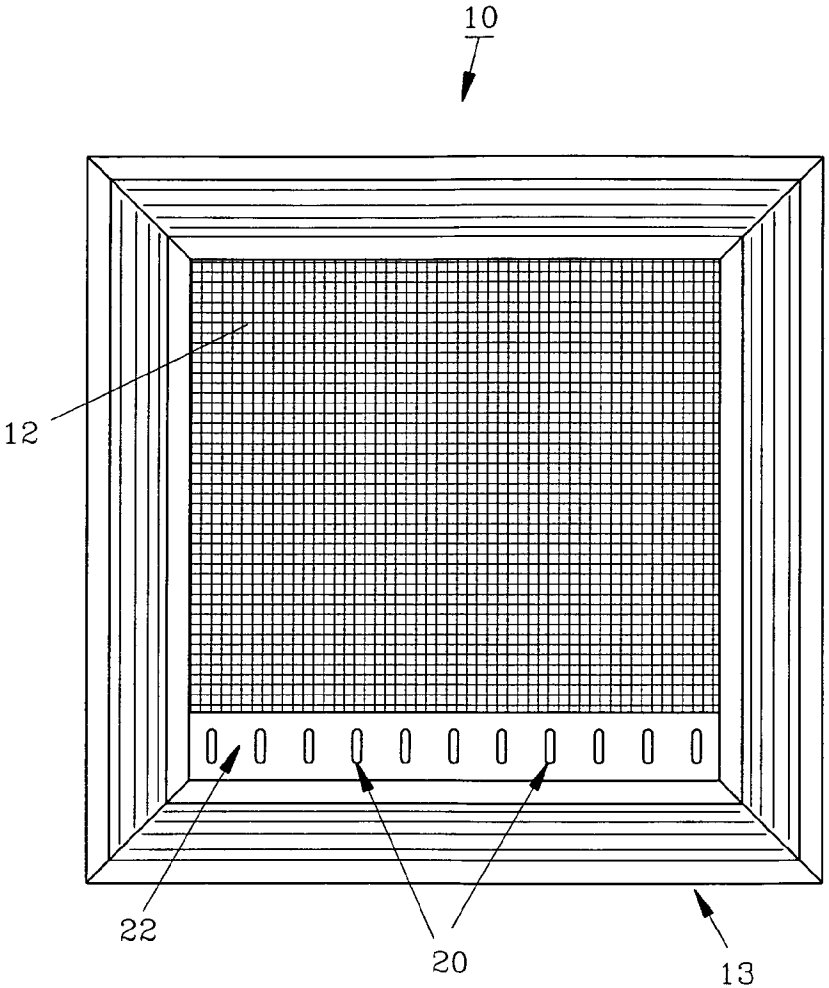
FIG. 2 demonstrates a closed front elevational view of the jewelry display.
Figure 4:
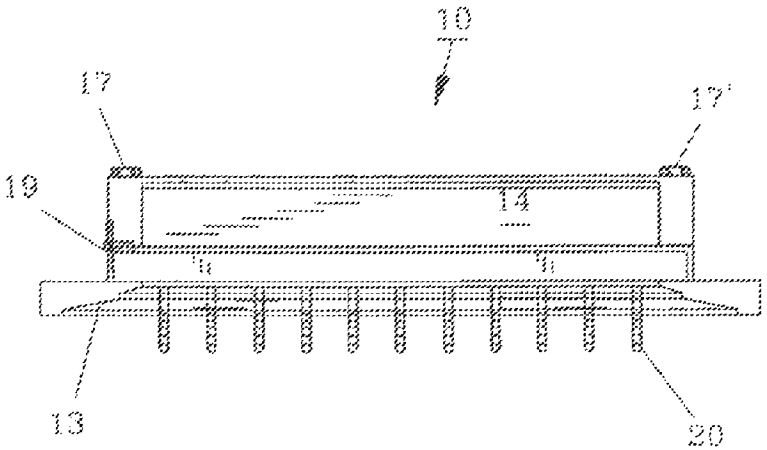
FIG. 4 shows a top plan view of the jewelry display as seen in FIG. 2.
Figure 5:
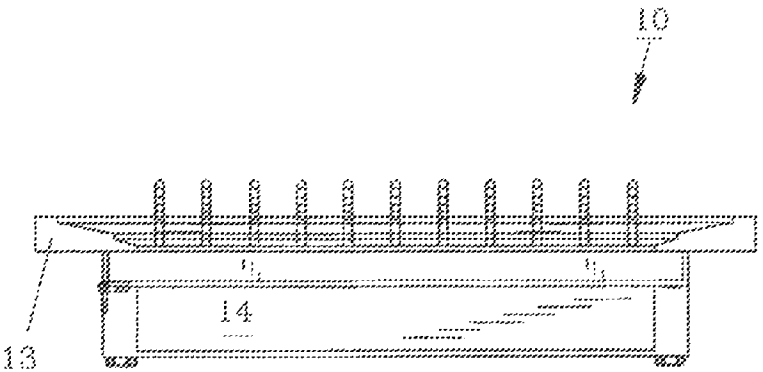
FIG. 5 pictures a bottom plan view of the jewelry display as seen in FIG. 2.
Figure 9:
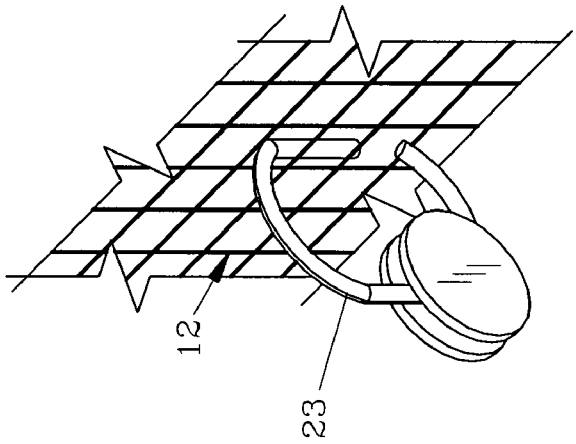
FIG. 9 illustrates a portion of the screen of FIG. 1 as removed from the jewelry display and enlarged having an earring positioned thereon.

As seen in FIGS. 4-7, closed jewelry display 10 forms a compact wall hung unit for placement on a vertical surface such as wall 30 shown in FIG. 1. When open as seen in FIGS. 1 and 8 jewelry display 10 provides ample storage for jewelry or other small personal objects positioned therein. Hooks 20 as seen in FIG. 2 affixed along the bottom of front frame 13 provide for temporary suspension of bracelets, necklaces or the like while dressing and mirror 11 can be used for observing the application of for example necklaces, earrings or cosmetics. Screen 12 allows easy access for example to earrings such as earring 23 or the like which can be temporarily attached thereto while dressing as illustrated in FIG. 9. The space (not shown) provided between screen 12 and mirror 11 allows room for various earring backings and to maintain mirror 11 scratch free. Mirror 11 is preferably formed from a conventional glass mirror and screen 12 is a typical metal window screen as formed from aluminum, although other suitable screens and mirrors can likewise be used such as those formed from polymeric materials.

Figure 7:
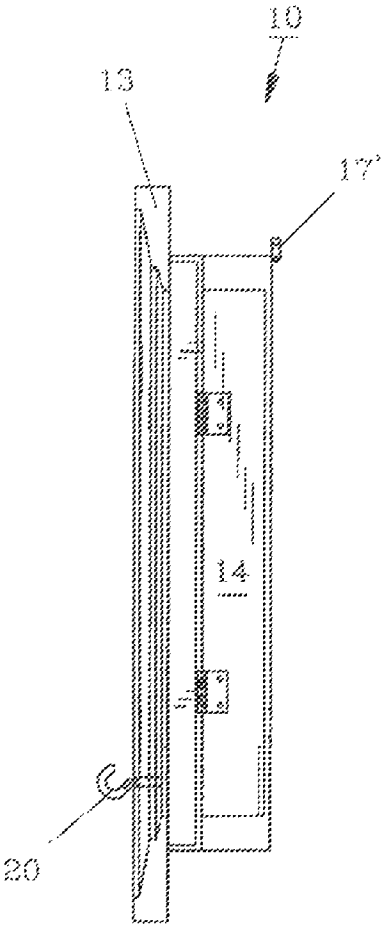
FIG. 7 features a closed right side elevational view of the jewelry display.

Jewelry display 10 is suspended from a door, wall or other convenient location by the use of wall fasteners 17, 17' which are standard eye hooks mounted on the back of rear compartment as shown in FIGS. 3, 6 and 7. Screws, nails or other fasteners 16 as shown in FIG. 1 are used to affix jewelry display 10 to wall 30. Once affixed, jewelry and the like (not shown) can be maintained within rear compartment 14 on shelves 15 or pocket 28 as seen in FIGS. 1 and 8 for easy access. Shelves 15 may include shelf slots 24 or posts 21 for ease in storage of rings, earrings, bracelets or the like. Pocket 28 provides for storage of larger jewelry items. When needed, front frame 13 is opened as seen in FIG. 1 and the desired jewelry (not shown) is removed therefrom and donned whereby front frame 13 can be closed (optional) and the placement and aesthetic appearance can be scrutinized by the wearer utilizing mirror 11. After use, frame 13 can again be opened and the jewelry or other objects replaced, for example on shelves 15.

The method of use includes the step of suspending jewelry display 10 from a vertical surface with wall fasteners 17, 17' positioned on fasteners 16. Next, jewelry display 10 is supplied with small jewelry or other selected objects by opening front frame 13 to access rear compartment 14 whereby the jewelry can be placed on shelves 15, posts 21, shelf slots 24 or in pocket 28. Front frame 13 is then closed against rear compartment 14 allowing magnets 26, 27 (FIG. 8) to engage and secure the jewelry therein.

As needed, frame 13 is manually grasped and pulled away from rear compartment 14 to reveal the jewelry stored therein for selection by the user. Once the jewelry is selected frame can be closed whereby mirror 11 can be utilized as the jewelry is applied. Upon removing the jewelry, it can be returned to rear compartment 14 for storage purposes.

The illustrations and examples provided herein are for explanatory purposes and are not intended to limit the scope of the appended claims.

I claim:

1. A jewelry display comprising: a front frame, a rear compartment, said front frame hingedly joined to said rear compartment, a mirror, a screen, said mirror positioned in said front frame, said screen positioned in said front frame forward of said mirror and spaced therefrom, a hook support, a plurality of hooks, said plurality of hooks attached to said hook support, said hook support attached to said screen, a shelf, said shelf attached to said rear compartment, said rear compartment defining a pocket, a post, said post attached to said rear compartment whereby said screen and said mirror are accessible while said front frame is closed and said pocket, said post and said shelf can only be used when said front frame is opened.

2. The jewelry display of claim 1 further comprising a pair of magnets, one of said pair of magnets attached to said front frame and the other of said pair of magnets attached to said rear compartment for sealing said jewelry display in a closed posture.

3. The jewelry display of claim 1 wherein said display further comprises a hanger, said hanger affixed to said display for suspending said display.

* * * * *